United States Patent [19]

Lambert et al.

[11] Patent Number: 4,507,998

[45] Date of Patent: Apr. 2, 1985

[54] FIREWOOD SAWING APPARATUS

[75] Inventors: Johnny H. Lambert, Meadows of Dan, Va.; Didier Primat, Collonge-Bellerive, Switzerland; William H. Edmiston; Johnny J. Edmiston, both of Lenoir, N.C.; James H. Edmiston, Boomer, N.C.

[73] Assignee: Primlumber, Inc., Meadows of Dan, Va.

[21] Appl. No.: 414,096

[22] Filed: Sep. 2, 1982 (Under 37 CFR 1.47)

[51] Int. Cl.[3] ..... B27B 7/00

[52] U.S. Cl. ..... 83/419; 83/417; 83/422; 83/425.2; 83/425.4; 83/435.2; 83/732

[58] Field of Search ..... 83/425.2, 425.3, 425.4, 83/423, 435.2, 422, 417, 419, 732, 418

[56] References Cited

U.S. PATENT DOCUMENTS

| | | | |
|---|---|---|---|
| 685,146 | 10/1901 | Johnson | 83/425.3 X |
| 1,123,056 | 12/1914 | Wooster | 83/425.3 X |
| 1,333,639 | 3/1920 | Sells | 83/732 X |
| 1,454,992 | 5/1923 | Willette | 83/425.2 X |
| 1,643,525 | 9/1927 | Shumaker | 83/732 X |
| 1,969,425 | 8/1934 | Richardson | 83/425.20 R |
| 2,109,365 | 2/1938 | Carll et al. | 83/425.4 X |
| 2,569,878 | 10/1951 | Avinger et al. | 83/425.4 X |
| 2,796,093 | 6/1957 | Mottet | 144/162 |
| 3,550,653 | 12/1970 | Gauthier et al. | 144/3 X |
| 4,148,344 | 4/1979 | Critchell et al. | 144/3 R |
| 4,164,965 | 8/1979 | Bodart | 144/3 K |
| 4,168,675 | 9/1979 | Chisum | 118/35 |
| 4,173,237 | 11/1979 | Heikkinen et al. | 144/3 K |
| 4,176,696 | 12/1979 | Greeninger | 144/3 K |
| 4,259,886 | 4/1981 | Seid et al. | 83/425.20 R |
| 4,269,242 | 5/1981 | Smith et al. | 144/192 |

*Primary Examiner*—Frank T. Yost

*Attorney, Agent, or Firm*—Charles R. Rhodes; Judith E. Garmon

[57] ABSTRACT

Logs which have previously been de-limbed are placed onto and removed from a loading deck one at a time and delivered to an aligning trough or mechanism where one end of all logs are moved to a common point. The logs are then conveyed one at a time by a feed conveyor in a direction transverse to the longitudinal axis of the logs and presented to a sawing mechanism where each log is sawed simultaneously into a plurality of shorter firewood pieces. The sawing mechanism includes a plurality of circular saws spaced longitudinally along a common axis which is, in turn, spaced above the level of the feed conveyor and extends parallel to the longitudinal axis of the logs. Each saw is individually mounted for ease of removal and adjustment. A spring device urges the log downwardly, while lugs on the feed conveyor at the same time urge the log forwardly through the sawing mechanism.

10 Claims, 8 Drawing Figures

FIREWOOD SAWING APPARATUS

BACKGROUND AND SUMMARY OF THE INVENTION

In recent years the concern over energy consumption and the cost of fuel has resulted in a tremendous increase in the use of wood stoves, fireplace inserts, and the like as a means for providing auxiliary domestic heating. As a result, the increased need for firewood, and the proximity of firewood to the consumer has resulted in the evolvement of commerical firewood businesses. The commerical processing of firewood naturally dictates that improved high speed processing equipment for sawing firewood pieces from logs must be made available in order to make the business commercially feasible. There have been several attempts in the past to design and develop firewood cutting or sawing systems. A representative sample of patents illustrating such attempts at commerical firewood cutting machines includes U.S. Pat. Nos. 3,550,653, issued Dec. 29, 1970; 4,269,242, issued May 26, 1981; and 4,173,237, issued Nov. 6, 1979.

In each of the above patents, as well as in all of the other known attempts at developing improved firewood cutting operations, a log is placed on some type of longitudinal conveyance apparatus, progressed to a stop, and presented to a circular blade or chain saw spaced from the stop to cut off a prescribed length of wood from the initial end of the log being cut. Upon completion of the cut, the saw is removed from the path of the log, the log indexed forwardly to the stop, and then the cutting operation repeated to provide a second firewood piece. The above operation is repeated until the log is cut into several pieces. As is evident, while this speeds up the cutting operation substantially, it is still relatively slow in that only one firewood piece is cut with each sawing step. Therefore, recognizing this problem, the present invention adopts a cutting system in which the log is presented to a plurality of spaced saws by moving the log in a direction transverse to its longitudinal axis, whereupon the log is simultaneously cut into a plurality of shorter firewood pieces.

While this may seem to be a simple procedure, it is not. Such a technique presents subtle problems which must be solved in order to make such a procedure operate successfully. For example, the log must be continuously urged through the saw blades during the sawing operation, or else it will be kicked rearwardly. A complication in this step resides in the fact that logs are by nature not necessarily straight. In addition, downward pressure must be exerted on the log during the entire cutting operation, or else the log may be kicked upwardly. Therefore, as can be easily seen and appreciated, it is necessary to have complete control over the log once it is engaged by the teeth of the saw blade, or else extremely hazardous consequences may result. Toward this end, in accordance with the present invention, cleats or lugs on the feed conveyor exert a continuous forward pressure on the logs and follow it into and through the path of the saw blades. Also, and simultaneously, downward pressure is exerted on the log as the cutting operation begins. This downward pressure is exerted in either or both of two ways. First, a spring means in the path of the log engages the log and biases the log downwardly during the cutting operation. Secondly, downward pressure is exerted as a result of the relative position of the saw blade with respect to the log. In this regard the saw blade is positioned so that the center of the cutting blade is above the level of the log. Therefore, the saw blade is moving downwardly and forwardly as it engages the wood of the log.

Another problem exists in the support of the saws themselves along a common axis. The most straightforward way to accomplish this would be, of course, to mount the saws along a common shaft which extends through the center of all saws and drive the shaft at one end by a pulley from the output shaft of a motor. However, while possible, in reality this presents at least two major problems. First to generate enough torque at one end to drive all saws evenly is difficult. Secondly, the blades and/or pulley belts are relatively quick to wear out. If the blades are mounted on a common shaft, access to the interior blades for removal is difficult. Therefore, in the present invention each saw in the array is independently mounted from a support structure and each saw is driven by its own pulley attached by a belt or chain to a corresponding pulley on a common drive shaft. There are a plurality of pulleys secured to the common drive shaft in accordance with a uniquie spacing pattern, so that the lengths of firewood into which the logs are sawed may be easily changed without moving pulleys.

It is also preferable that all logs be presented to the array of cutting blades with the initial end of each log spaced from the first saw blade a constant prescribed distance, so that the firewood piece which is formed between the initial end and the first saw blade is of a known and consistent length. The opposite end of the logs will of course vary depending upon the length of the logs; however, only one scrap piece will result from each log. Toward this end, before the logs are fed to the sawing mechanism they are all moved longitudinally to a bumper and therefore the initial end of each log proceeds into the sawing mechanism in a common plane.

In accordance, then, with the broadest aspect of the present invention, there is provided an apparatus for sawing firewood pieces which includes a feed conveyor means for advancing logs in serially spaced arrangement in a direction transverse to the longitudinal axis of the logs to a discharge end. A sawing means is positioned adjacent the discharge end of the feed conveyor for receiving logs discharged therefrom. The sawing means preferably includes an array of longitudinally spaced, circular saws mounted along a common axis which axis, in turn, extends parallel to the longitudinal axis of the incoming logs.

In a preferred embodiment, the saws are individually mounted and include a biasing device between each adjacent pair of saws for maintaining a constant forward and downward pressure on the logs as they pass through the sawing mechanism to prevent inadvertent discharge of one or more firewood pieces upwardly or rearwardly out of the sawing mechanism. In this preferred embodiment the biasing means first includes upstanding lugs or cleats on the feed conveyor for providing the necessary forward pressure on the logs during the sawing operation. Secondly, the downward pressure on the logs during the sawing operation is accomplished either by mounting the longitudinal axis to the saw at a horizontal level above the logs themselves or by providing a spring device between each pair of saw blades which engages the logs and provides a constant downward bias thereto during the sawing operations, or by utilizing both techniques.

Further, in the preferred embodiment, there is provided an aligning means in the form of a V-shaped trough extending across and immediately downstream of the discharge end of the loading deck into which the logs are initially delivered. A longitudinal conveyor or urging means moves the logs longitudinally down to a bumper at one end of the trough, whereupon they are tilted, dumped, or otherwise delivered onto a feed conveyor and presented to the sawing mechanism with the initial end of each log passing in a common plane and equally spaced from the first cutting blade.

While the above discussion, and the discussion in the remainder of the specification is primarily directed to a log cutting operation, it is apparent that the same concepts would be equally applicable to an apparatus which cuts boards into shorter lengths. Also, while it may be implied from the discussion hereinabove that the saws are equally spaced along the common axis, this is not necessary if it is not desired that all firewood pieces be of equal length. It can be easily seen that the distances between blades might be changed to provide some logs of one length, some of another, and some of even a third or fourth length. It is pointed out, however, that the basic concept of the present invention is the idea of presenting logs to a cutting apparatus in a direction transverse to the longitudinal axis of the log, so that a plurality of logs are simultaneously cut and to provide means for maintaining proper control over those logs during such cutting operation.

It is therefore an object to provide an improved commercial firewood cutting apparatus.

It is another object of the present invention to provide a firewood cutting apparatus of the type described in which logs are presented to a plurality of circular saws in such a manner that a plurality of firewood pieces are cut simultaneously as the log passes the saws.

A further object of the present invention is to provide a firewood cutting apparatus of the type described in which control is maintained over the logs as they pass the sawing mechanism to prevent inadvertent discharge of the one or more firewood pieces upwardly or rearwardly from the mechanism during the cutting operation.

Other objects and a fuller understanding of the invention will become apparent upon reading the following detailed description in conjunction with the accompanying drawings in which.

DETAILED DESCRIPTION OF A PREFERRED EMBODIMENT

Figure 1:
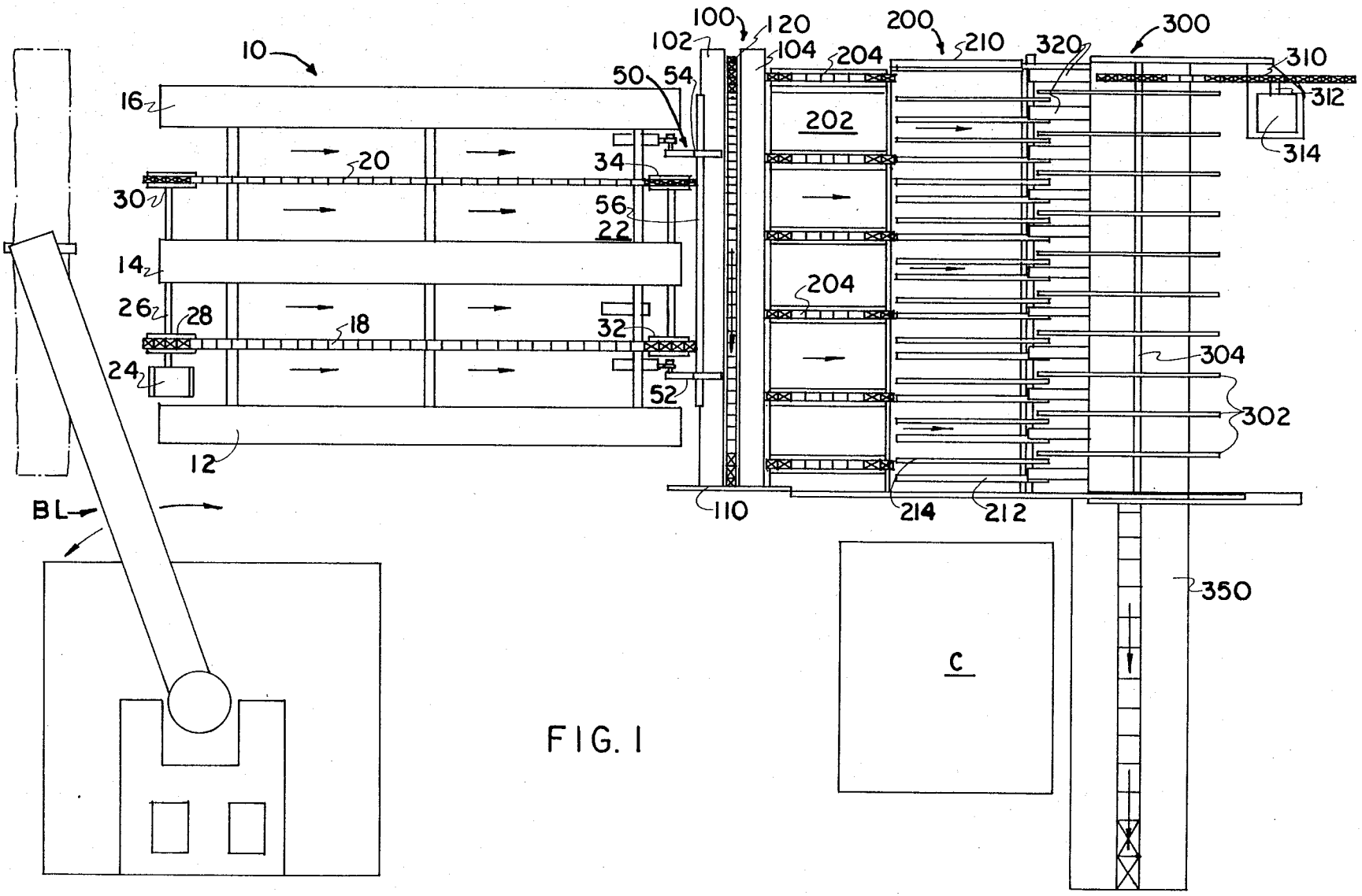
FIG. 1 is a top view schematically showing the various stations of the firewood sawing apparatus and their relation to each other.
Figure 2:
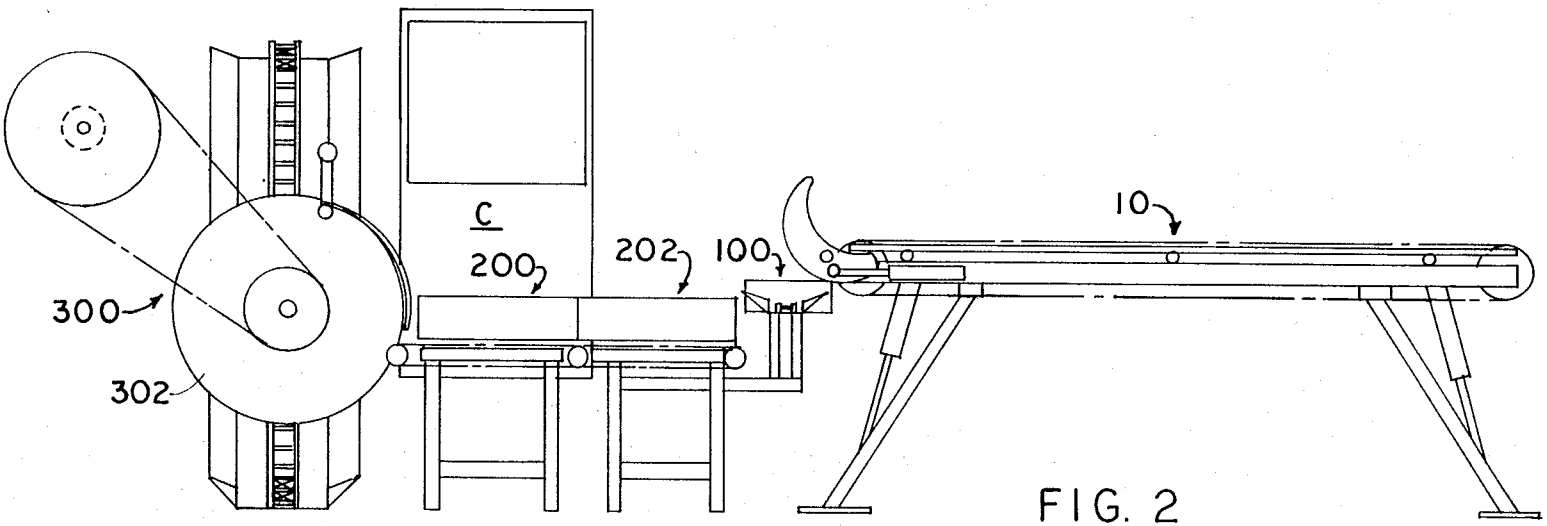
FIG. 2 is a side view of the apparatus illustrated in FIG. 1.
Figure 3:
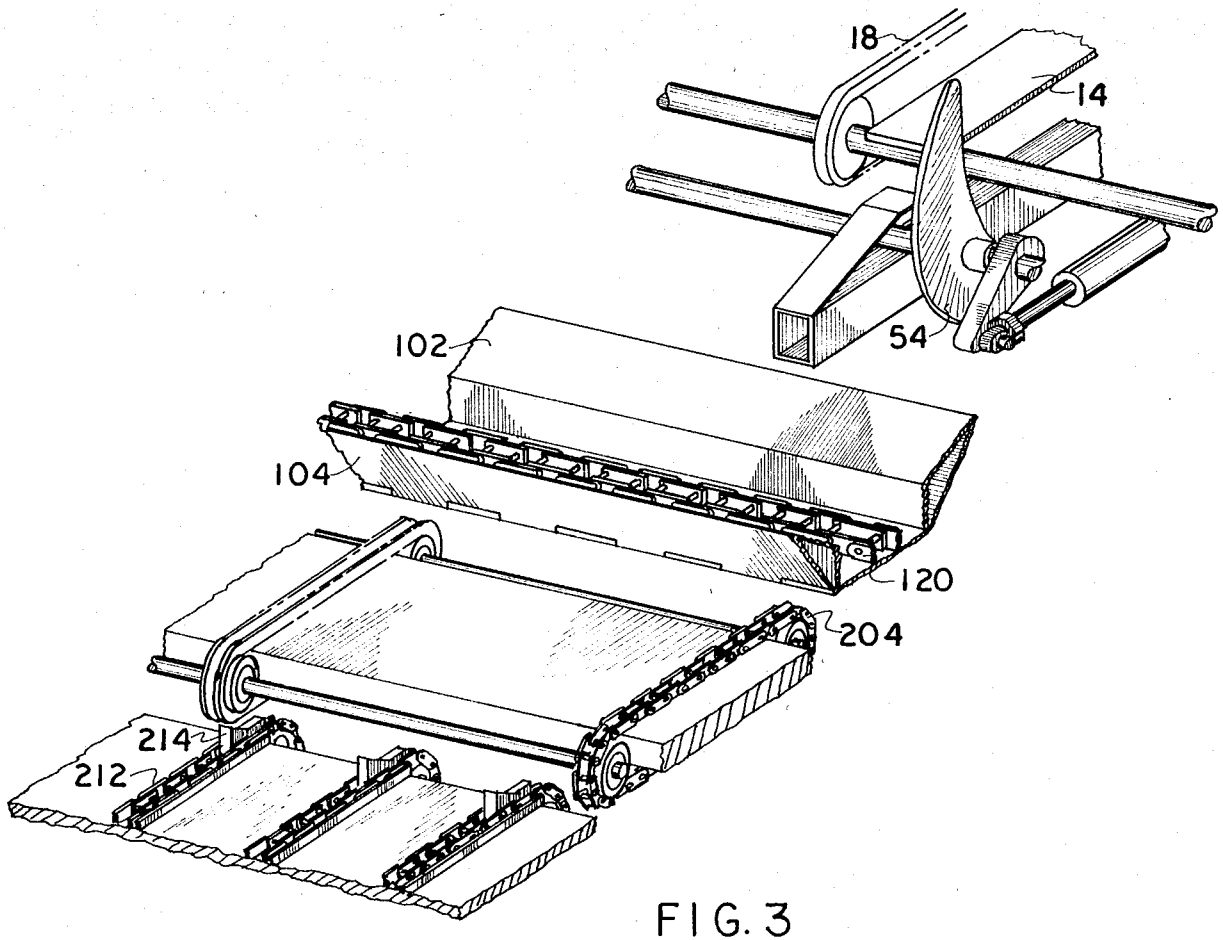
FIG. 3 is a perspective view, with parts broken away, and illustrating the discharge end of the loading deck, the discharge mechanism, the aligning trough, and the initial end of the feed conveyor.

Turning now to the drawings, and particularly to FIGS. 1 and 2, there is illustrated the firewood sawing apparatus according to the present invention. In general, the apparatus includes a loading deck or platform 10, an aligning trough 100, a feed conveyor 200 and the sawing mechanism 300.

Logs L are initially loaded onto the loading platform 10 by a knuckle-boom loader BL in such a manner that the longitudinal axis of each log extends substantially across the width of loading deck 10. The logs progress along the loading deck 10 to a discharge end at which is positioned a crescent type discharge mechanism 50 of known conventional construction. The logs are picked off of the loading platform 10 one at a time by the crescent discharge mechanism 50 and dropped into an aligning trough 100 which is so positioned downstream as to receive logs that are dropped from the crescent discharge mechanism 50.

Figure 4:
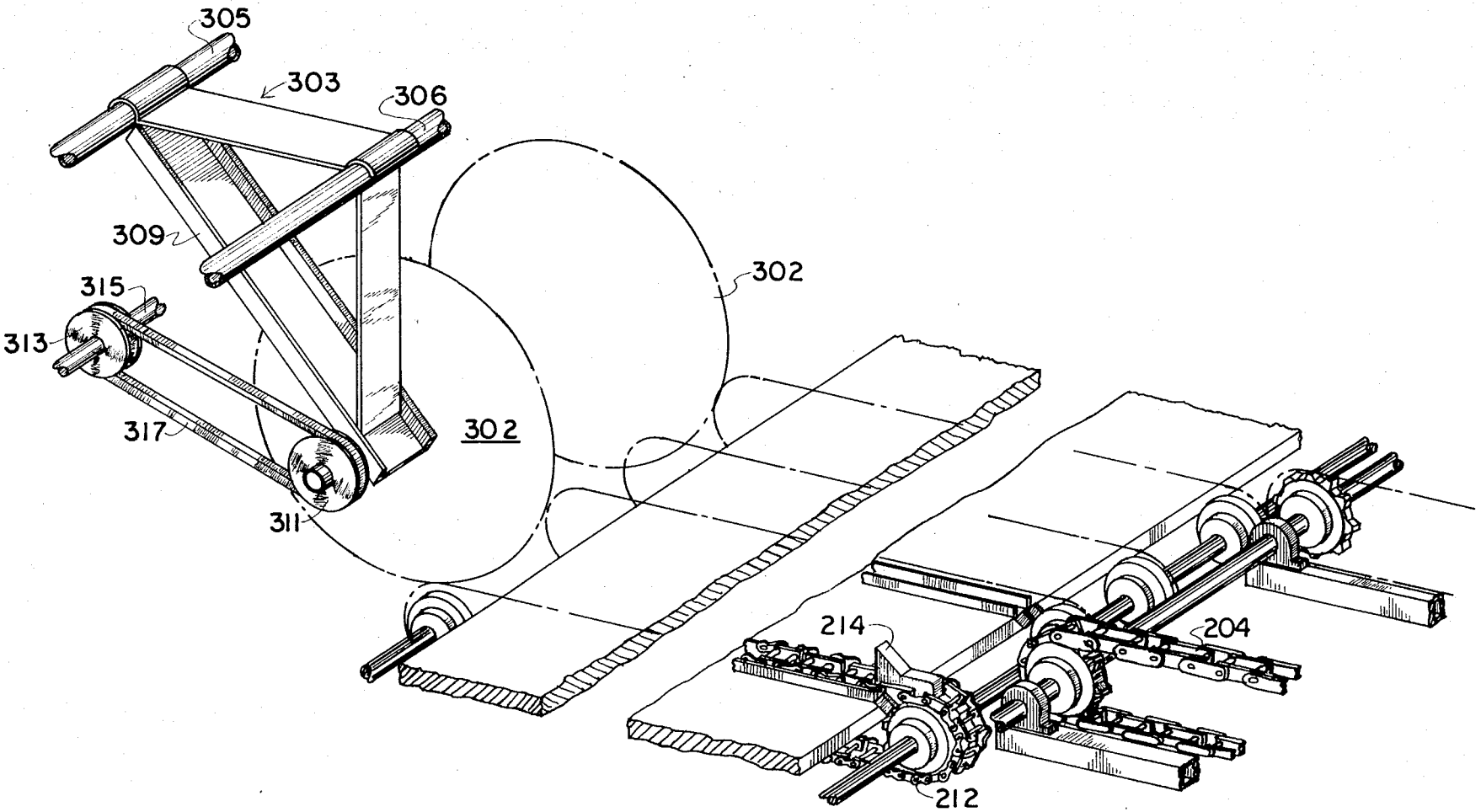
FIG. 4 is a perspective view with parts broken away, illustrating the discharge end of the feed conveyor and the entrance to the sawing mechanism.
Figure 5:
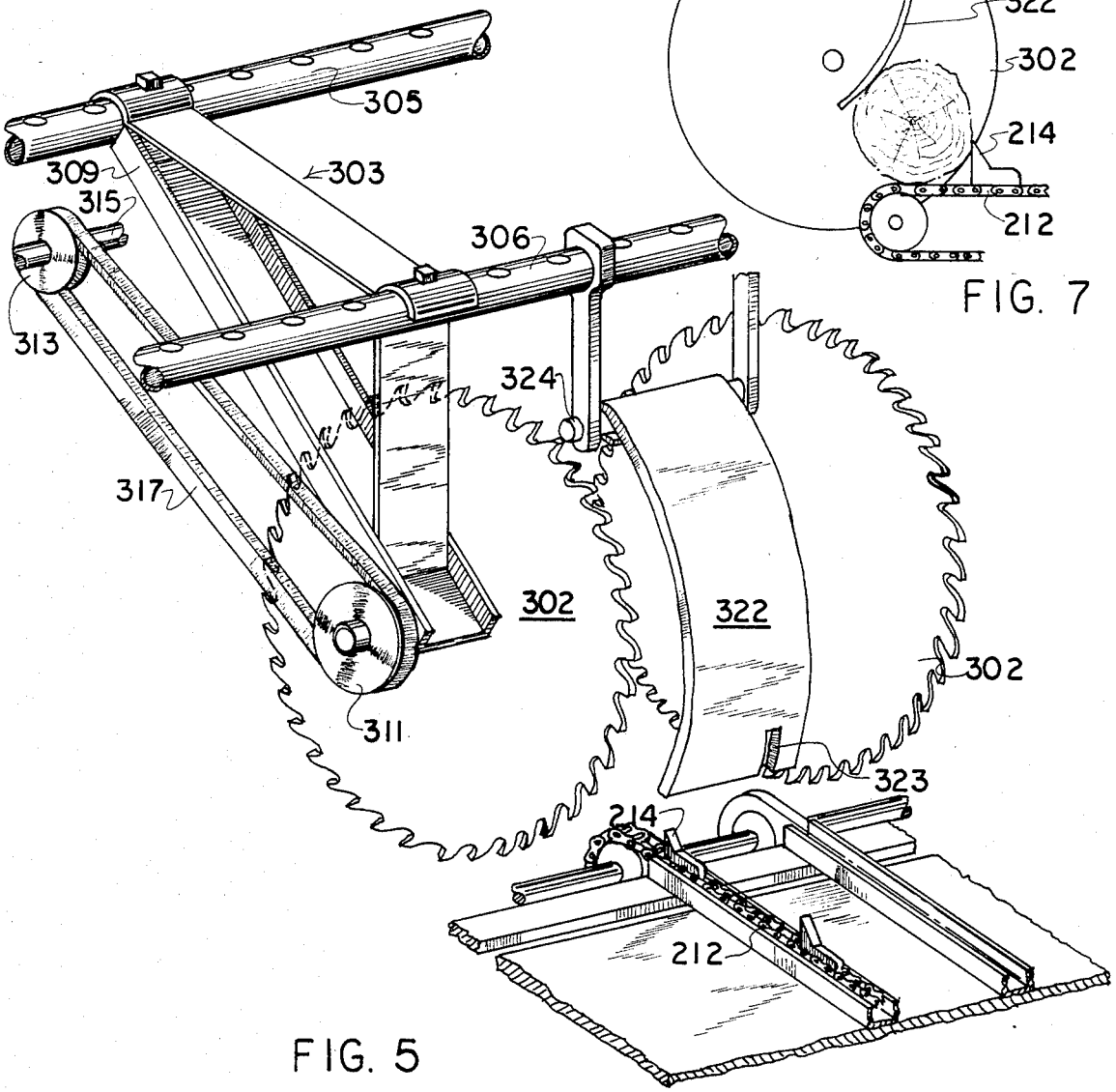
FIG. 5 is an enlarged perspective view, with parts broken away, illustrating two adjacent saw blades and showing the relation between the saw blades and the biasing means.

In the aligning trough 100, each log is moved toward a bumper 110 at one end thereof by means of a chain conveyor 120 in the bottom of the trough. Once the log is aligned, the trough, or at least the downstream side thereof is tilted to deposit the log onto the receiving end of the feed conveyor 200. The log moves along the feed conveyor 200 by means of upstanding lugs (to be described hereinafter) until it is presented to the sawing mechanism 300. Although FIG. 1 shows schematically that the saws are mounted on a common shaft 304, in the preferred embodiment as illustrated in FIGS. 4 and 5 and described hereinafter, the saws are separately mounted, not on a common shaft, although they are driven from a common drive shaft. The aforementioned lugs urge the log through the saw blades until the log is sawed completely through, whereupon the firewood pieces drop into a removal conveyor 350, from when they are transported transversely of the apparatus and dumped into a truck or other discharge area.

As set forth hereinabove, the logs are conveyed in a feed path that is transverse to the longitudinal axis of the logs and on through the sawing mechanism 300, so that a plurality of logs are sawed simultaneously, thereby substantially increasing the production and making the apparatus commercially feasible to produce firewood pieces on a production basis.

Turning now to a discussion of the structural features of the components, first of all platform 10 is formed by a plurality of support rails 12, 14, 16 extending horizontally and parallel to each other to form a platform. Rails 12, 14 and 16 are connected and supported by appropriate framework in a well-known manner. The deck 10 may also include levelling devices and retractable wheels to make it transportable from site to site. A conveying means is provided to move logs from one end of the platform down to a discharge end 22. The conveying means preferably includes a pair of movable chains 18,20, each of which contain upstanding lugs 21 which engage and move the logs along platform 10 as the chain progresses in the direction of arrows in FIG. 1. Chains 18 and 20 extend around drive pulleys 28,30 respectively at one end and around idler pulleys 32,34 respectively at the other. An electric motor 24 having the output shaft thereof connected to a drive shaft 26 extending between pulleys 28,30 provides the moving force necessary to ensure that the chains 18,20 continuously move in their intended fashion. As chains 18 and 20 progress along log deck 10 logs are continuously urged toward the discharge end 22 where they are delivered into a rotatable log holder 50.

The aforementioned rotatable log holder 50 includes a pair of crescent-shaped arms or pockets 52,54 which are moved back and forth between a first receiving position where the leading edges 52*a* and 62*a* are below the level of support beams 12, 14, 16. To provide common rotation, the crescent-shaped arms 52, 54 are connected by a common shaft 56. Shaft 56 includes a depending activating rod or plate 58 which is pivotally connected to the free end of the piston 60 of a hydraulic cylinder 62. The opposite end of cylinder 62 is mounted to the framework of platform 10. So arranged, the crescent-shaped log holder 50 operates, responsive to movement of piston 60 through plate 58, back and forth between the aforementioned receiving position and a delivering position which is clockwise therefrom as seen in FIG. 2. When in the delivery position the holder 50 it tilted so that logs received by holder 50 are dropped one at a time into a aligning trough 100. The operation of the crescent-shaped log holder 50 is disclosed herein as being controlled by an operator from cab C, however, could be part of an automated timing sequence.

Aligning trough 100 includes a pair of side walls 102,104 arranged in a V-shape to converge toward the bottom. A chain-type conveyor 120 or other moving means urges each log deposited in trough 100 in the direction of the arrow of FIG. 1 toward and into engagement with a bumper or end plate 110. This will ensure that all logs are presented to the sawing mechanism 300 with the initial end of each log passing in a common plane, so that the first cut is indeed a full length cut. Otherwise, there would be waste wood at the initial end of logs presented to the sewing mechanism.

Trough 100 is obviously mounted on a level beneath the loading platform 10 and beneath the rear ends 52*b*, 54*b* of discharge ends arms 52,54 so that as a log falls out of the crescent-shaped log holder 50 because of gravitational effect, it will drop into trough 100. For the same reasons, trough 100 is mounted at an elevation above feed conveyor 200 so that as it is tipped clockwise in FIG. 2, the log will roll out of the trough 100 onto the feed conveyor 200. The aligning trough may be mounted for rotation in any of a number of ways. For example, the trough could be pivotally mounted on a shaft extending between a pair of end abutments, and a hydraulic cylinder could be connected to the trough to rotate in a similar manner to that utilized for rotating the crescent log holder 50. Alternatively, the trough could be fixed on the shaft and the shaft rotated. Further, the downstream side wall 104 of trough 100 could be pivotally attached at the bottom, so that as the wall is withdrawn, the log drops out. The apparatus shown and described is merely exemplary of one of many ways in which this operation could be affected.

The feed conveyor means 200 includes a first conveyor means 202 in the form of a table having a plurality of movable chains 204 extending therealong. The first feed conveyor 202 is more of a log storage table than a feed table, as it may contain a plurality of logs awaiting delivery onto the second table 210 which ultimately delivers the logs one at a time into the sawing means 300. Table 210 of feed conveyor 200 includes a plurality of chain drives 212, each of which includes a plurality of upstanding lugs 214 for driving the logs therealong into the sawing means. It should be noted, and it is important that there are two chain flights between each pair of saws, so that the logs are driven into and through the space between the saws evenly and consistently. Also, it should be noted that preferably the lugs 214 are aligned so that pressure is equal against a log all the way along its length. Of course it is realized that all logs are not absolutely straight; however, it is believed that by aligning the lugs, the best results will be achieved. The chain flights 212 extend over pulleys at each end, one end of which is connected by a common shaft 216 to a drive motor or pulley 218 positioned at one end or at one side of the conveying means 200 and connected directly or indirectly by belts or chains to a power source.

The sawing mechanism 300 includes an array of circular saws 302 mounted in a longitudinally spaced arrangement along a common axis.

The sawing mechanism 300 is best shown in FIGS. 4 and 5. As previously described each saw blade 302 is mounted independently of the others so that each saw can be separately removed and replaced. Toward this end a support frame 303 is adjustably mounted on a pair of upper supports 305,307 and secured in place by bolts extending through corresponding holes in supports 305,307. A short shaft 304 extends through a support channel 309 and carries the saw blade 302 on one side of channel 309 and a pulley or sheave 311 on the other side thereof. The pulley 311 is then operatively connected to a drive pulley 303 secured to a common drive shaft 315 by means of a belt or chain 317. One or both ends of drive shaft 315 is connected by a chain or belt 310 to the output shaft 312 of an electric motor 314 or some other drive mechanism which drives all the saws simultaneously. As illustrated best in FIG. 2, a protective cover extends over the saws to prevent damage in case a firewood piece is actually discharged upwardly and also tends to hold down the discharge of sawdust to some extent. A spring bias means 320, as will be described hereinafter, is mounted to or suspended from the forward upper support 306 between each pair of saws.

Turning now to FIG. 5, a greatly enlarged segment of the interface between the discharge end of the feed conveyor and the sawing mechanism is illustrated which includes a pair of saws adjacent each other along a common axis. The aforementioned forwardly biasing means is the upstanding lugs 214 on chains 212, which lugs are generally aligned across the width of the feed conveyor to maintain as constant a pressure against each log as possible.

Figure 6:
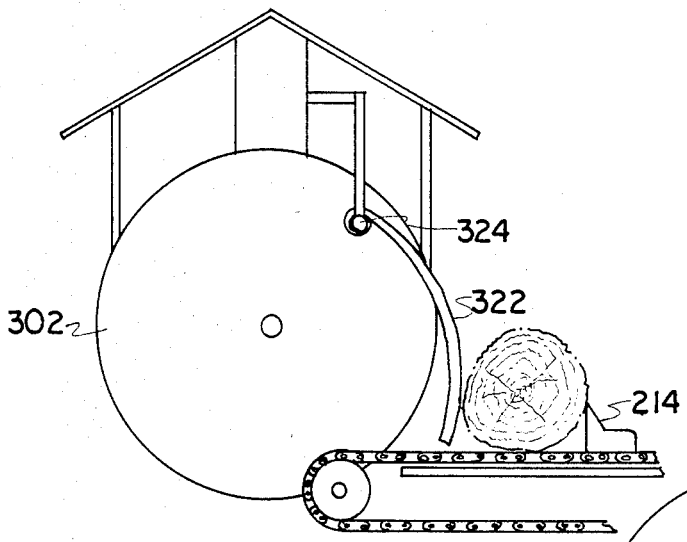
FIG. 6 is a sectional view taken along lines 6—6 in FIG. 1, schematically illustrating a log being delivered to the sawing area.
Figure 7:
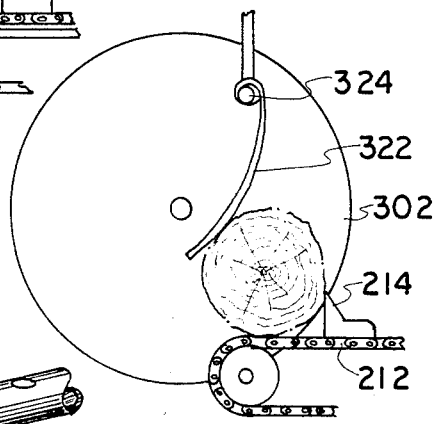
FIG. 7 is a sectional view taken substantially along lines 6—6 in FIG. 1, and similar to FIG. 6 except showing the operation at a later stage.

One aspect of the downwardly biasing means referred to hereinabove is illustrated as an arcuate steel band 322 which is supported at one end by a rod or shaft 324 between adjacent blades 302, and in turn secured to the framework at rear support 307. A similar band 322 is provided between each adjacent pair of saw blades 302. Each band 322 extends rearwardly and downwardly in a curved path from the supported end to the distal end 323 which is spaced upstream from the periphery of saws 302, so that any log or portion thereof being moved along the conveying means 200 will first engage the band 322 prior to the time it enters the saw blades 302. In FIGS. 6 and 7, the action of biasing means 320 can better be seen during the sawing operation by noticing the relative positions of the spring band 322. It will become apparent that each curved band 322 provides a continuous downward pressure against a log as it moves through the sawing blade to prevent inadvertent discharge upwardly or rearwardly therefrom. The band 322 cooperates with the oncoming lugs 214 to provide good control over the log as it passes through the sawing operation.

Further, in accordance with a second aspect of the downwardly biasing means, it should be noted that there is an important relationship between the relative position of the feed table 210 and the shafts 304 upon which the saws are mounted. Each shaft 304 is substantially elevated at least ten inches above the surface of table 210, ten inches being about the greatest diameter of logs to be cut into firewood. As the log passes through the sawing mechanism, the saw blade will only engage a log as it is moving downwardly and forwardly, thereby tending to aid the forward and downward desired bias on the log.

After the log is sawed into a plurality of firewood pieces, the drop into a conveyor 350 which moves the logs transversely of the apparatus in a well-known manner and dump them in an awaiting truck or other storage container or facility.

Figure 8:
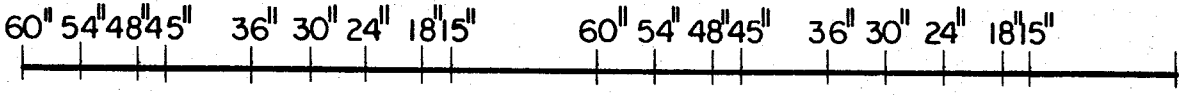
FIG. 8 is a schematic representation of the drive shaft showing the unique spacing pattern.

FIG. 8 illustrates the pulley arrangement on drive shaft 315. Such an arrangement facilitates the sawing of logs into lengths of 15,18, or 24 inch lengths without any pulley adjustment. It is only required to rearrange the saws 302 on front and rear supports 305,307, and then connect the appropriate pulleys 313 on drive shaft 315 to the pulley 311.

While a preferred embodiment has been described in detail hereinabove, it is apparent that various changes and modifications might be made without departing from the scope of the present invention which is set forth in the accompanying claims.

What is claimed is:

1. A firewood sawing apparatus comprising:

(a) a loading deck having an upper surface onto which logs are initially placed in parallel arrangement and means for advancing said logs in a direction transverse to the longitudinal axis thereof to a discharge end;

(b) a feed conveyor means positioned adjacent the discharge end of said loading deck for receiving logs deposited thereon and advancing means for moving logs in a serially spaced arrangement in a direction transverse to the longitudinal axis thereof to a feed conveyor discharge end;

(c) an aligning trough positioned between said loading deck and said feed conveyor for shifting all logs deposited in said aligning trough against a bumper at one end thereof; and means for depositing said logs one at a time from said loading deck onto said aligning trough; whereby one end of all logs proceed through said feed conveyor and said sawing means in a common longitudinal plane such that the initial end of the log cut by the first saw will be substantially of the same length from all logs;

(d) sawing means adjacent said feed conveyor discharge end for receiving logs discharged therefrom, said sawing means comprising a plurality of longitudinally spaced, circular saws mounted along a common axis extending parallel to the longitudinal axis of said logs being discharged;

(e) whereby logs are presented one at a time to the sawing means and a single log is cut simultaneously into a plurality of firewood pieces.

2. The firewood sawing apparatus according to claim 1 wherein said sawing means includes a bias means for maintaining constant forward and downward pressure on said logs during the sawing operation to prevent inadvertent discharge of one or more firewood pieces upwardly or rearwardly out of the sawing means.

3. The firewood sawing apparatus according to claim 2 wherein said bias means, at least partially includes an arcuate shaped spring band mounted between each adjacent pair of circular saws and having a portion thereof in the path of said logs and engaged by said logs prior to engagement of said logs by said saws.

4. The firewood sawing apparatus according to claim 3 wherein said arcuate shaped spring band includes at least one end thereof mounted above and rearwardly of the common axis along which said saw blades are mounted and extending downwardly and rearwardly to a point rearwardly spaced from the periphery of said saw blades in the path of logs being delivered to the sawing means.

5. The firewood sawing apparatus according to claim 2 wherein said common axis along which said saws are mounted is at an elevation at least ten inches above the horizontal plane formed by the surface of said feed conveyor means adjacent the discharge end thereof, whereby logs are engaged by said saw blades only in a downwardly and forwardly directed motion.

6. The firewood sawing apparatus according to claim 5 wherein said bias means further includes an arcuate shaped spring band mounted between each adjacent pair of circular saws and having a portion thereof in the path of said logs and engaged by said logs prior to engagement of said logs by said saws.

7. The firewood sawing apparatus according to claim 1 wherein said trough comprises a pair of side walls converging downwardly to a chain conveyor positioned in the bottom thereof, said chain conveyor operative to urge logs deposited in said trough down toward one end thereof and up against said bumper means.

8. The firewood sawing apparatus according to claim 1 wherein each saw is separately mounted from a support whereby each saw may be removed and replaced independently of the others.

9. The firewood sawing apparatus according to claim 8 and further including a means for laterally adjusting each saw to vary the distance between adjacent saws, whereby the resulting logs may be cut in a variety of lengths.

10. The firewood sawing apparatus according to claim 9 wherein said means for adjusting the distance between said saws comprises a pair of spaced parallel support bars on which said saw supports are mounted; each of said support bars including a plurality of spaced apertures along the longitudinal axis thereof, the apertures in one of said support bars being in alignment with the apertures in the other of said support bars; said saw support having a mounting means which is aligned with a selected aperture on one of said support bars and the corresponding aperture on the other of said support bars and including a fastening means for placement through said saw support mounting means and said apertures to attach the saw to said support bars; whereby when it is desired to adjust the lateral position of the saw blades, said fastening means may be removed and the saw support moved laterally in either direction to align with selected others of said apertures.

* * * * *